United States Patent [19]

Przybyla et al.

[11] Patent Number: 4,612,791

[45] Date of Patent: Sep. 23, 1986

[54] METHOD AND APPARATUS FOR ROLLING TRANSVERSELY RIBBED BIMETALLIC PIPES

[75] Inventors: Janusz Przybyla, Zabkowice Bedzińskie, Zygmunt Goź dziewicz, Kedzierzyn-Koź le; Andrzej Szal, Kedzierzyn-Koź le; Ryszard Zub, Kedzierzyn-Koź le; Andrzej Maczyński Gliwice, all of Poland

[73] Assignee: Zaklady Urzadzen Chemicznych Metalchem, Kedzierzyn-Koź le, Poland

[21] Appl. No.: 622,203

[22] Filed: Jun. 19, 1984

[51] Int. Cl.[4] ..... B21D 53/06

[52] U.S. Cl. ..... 72/98; 29/157.3 AH

[58] Field of Search ..... 72/78, 95, 96, 98, 107; 29/157.3 AH

[56] References Cited

U.S. PATENT DOCUMENTS 3,683,656 8/1972 Lewis ..... 72/98

4,153,982 5/1979 Przybyla et al. ..... 72/98

FOREIGN PATENT DOCUMENTS 79817 4/1977 Poland .

*Primary Examiner*—Lowell A. Larson

*Attorney, Agent, or Firm*—Ladas & Parry

[57] ABSTRACT

A method and apparatus for rolling transversely ribbed pipe consists in that the rib after forming is deflected in the direction of rolling parabolically, the external pipe is pressed down to the core pipe, and deflecting the rib and pressing down the external pipe onto the core pipe is carried out during one revolution of the pipe, and afterwards the rib is straightened.

The apparatus has three tools provided with roll-formed disks, for supporting and straightening, whereby the second - in the direction of rolling - part of the profile of supporting disks is concave, preferably parabolically, and the last - in the direction of rolling - tool is provided with a supporting disk the outer diameter of which is from 0.1 to 0.8 mm larger than the outer diameter of the other supporting disks.

3 Claims, 4 Drawing Figures

METHOD AND APPARATUS FOR ROLLING TRANSVERSELY RIBBED BIMETALLIC PIPES

BACKGROUND OF THE INVENTION

The subject of the invention is a method and apparatus for rolling laterally ribbed bimetallic pipes, especially with small thicknesses of ribs, finding the application in heat exchangers.

Rolling the ribs on tubes consists in pressing down rotationally driven multi-disk tools to the surface of the tube. Usually a set of three tools is used, comprising sets of disks realizing several stages of producing the rib, which are progressively deforming the tube, drawing the rib and forming the shape of the rib.

In the case of producing bimetallic tubes additionally the external ribbed tube is pressed down to the internal core tube in order to provide for good adhesion of tubes and an improvement of thermal conduction.

Those skilled in the art know a method of rolling the ribs, in which the external tube is pressed down to the internal tube in the last stage of forming the shape of ribs. In this method described for example in the USSR patent specification no. 217344 all tools are provided with the last - in the direction of rolling - disks of an increased diameter, causing the formation of additional radial forces which causes pressing down the tubes. It has been observed, however, that in the result of the action of friction forces and the increase of the perimeter of the rib being thinned, radial forces of the opposite direction appear therein, which causes tearing off the material of the external tube from the internal tube and, in consequence, formation of a sub-rib draw-in, and thus, a gap between the tubes.

Another tool for rolling ribs in bimetallic tubes is known from the Polish patent specification No. 79817. In the said tool, in order to eliminate the inter-tube gap a set of unsymmetrical plano-convergent disks is additionally applied. Such a design of the tool enables in the first stage the formation of a low rib, and then intensive billateral thinning thereof with simultaneous increasing the height thereof. The thinning process creates the tendency to increase the perimeter of the rib, whereas limiting the radial flow of metal in the region adjacent to the tops of initial disks leads to the formation of the draw-in directly under the rib. The set of unsymmetrical disks performs the work causing the previously formed draw-in to be shifted to the region of the direct action of the last burnishing disk.

Realization of the above presented method of pressing down the external tube to the internal tube by means of several unsymmetrical disks causes considerable loads along the axis of the tool, which hinder the practical utilization of the said solution in rolling ribbed tubes of very small pitches and small thicknesses of ribs.

Those skilled in the art know also from the Polish patent specification No. 113419 a method of rolling ribs by introducing after initial deforming the tube, drawing and forming the rib, additional operations consisting in annealing and then flexing several-times-repeated the ribs in relation to the axis perpendicular to the direction of rolling, and pressing down the external tube to the core tube during contraflexure. The tool for realization of the said method comprises, apart from the known sections of initial disks, a supporting disk increasing the rigidity of the tool and initially deflecting the rib, a section of counter-flexure disks at a certain distance from this disk, inside which there are burnishing disks, and also, as the last one, the disk for straightening the rib. By the method and the tool according to the said invention it is possible to carry out industrial rolling of ribs having an average thickness not smaller than 0.45 mm and an average slenderness ratio of up to 1:40. At further thinning the rib a significant influence on the formation of the rib is gained by certain defects, included in production standards for pipes, on the surface of smooth charge tubes. These defects cause local cracks in the rib and as result lead to destruction of the rib band in the stage of multiple contraflexure.

SUMMARY OF THE INVENTION

The essence of the method according to the invention of rolling transversely ribbed bimetallic pipes with rotational tools with roll-formed disks, in which an external pipe is initially deformed, the rib is drawn and the shape thereof is formed, and immediately after forming the rib the external tube is pressed down onto the core pipe and - in the final stage of rolling - the rib is straightened, consists in that the rib after forming is deflected in the direction of rolling non-linearly, preferably parabolically, and then the external tube is pressed tightly down onto the core pipe, whereby deflection of the rib and pressing down the external pipe to the core pipe is carried out during one revolution of the pipe and afterwards the rib is straightened.

In the presented method of rolling the rib is deflected unilaterally non-linearly - parabolically, due to which deflection of the rib at the base thereof is negligible, which protects it against destruction even in the case of local cracks in the rib caused by defects of the surface of the pipe being rolled. Moreover, pressing down the external pipe to the inner core pipe realized immdiately after deflecting the rib during one revolution of the pipe eliminates the necessity of conducting the rib through subsequent stages of the treatment thereof, reducing the number of contraflexures harmful to very thin ribs. By this method it is possible to roll industrially for example on aluminium tubes ribs of an average thickness of from 0.3 to 0.4 mm.

The essence of the appartus for rolling transversely ribbed bimetallic pipes according to the invention consists in that the set composed of three tools, of which each one comprises roll-formed disks forming a section for deforming the pipe, the section of drawing the rib and the section of forming the shape of the rib, and a supporting disk and a straightening disk, has supporting disks with the profile of the first - in the direction of rolling - part corresponding to the profile of the last forming disk, and the second part of a concave profile. The outer diameter of the last - in the direction of rolling - supporting disk is from 0.1 to 0.8 mm larger than the outer diameter of the other supporting disks. The concave profile of the second part of supporting disks is preferably a segment of a parabola, included within the quantity range x from 0 to 6 mm in the equation $y=Ax^2+Bx+C$, where axis x is the axis of the tool, axis y lies in the plane of the base of the supporting disk, coefficient $A>0$, coefficient $B\geqq 0$, and coefficient C corresponds to the quantity fo the radius of the base of the supporting disk.

The apparatus for rolling is characterized by great rigidity and is simple in design. By increasing the outer diameter of the last supporting disk - this disk the least loaded with forces along the axis performs the additional work of pressing down the external pipe to the core pipe. It has appeared that such pressing down with one supporting disk after previous deflecting the rib enables obtaining bimetallic pipes practically without the inter-pipe gap, of correct parameters of thermal conduction. The parabolic shape of supporting disks is close to the optimum shape of the section of the supporting disk of constant bending strength, said bending being caused by rolling forces along the axis.

BRIEF DESCRIPTION OF THE DRAWINGS

The invention will be now presented in more detail in drawings, wherein.

DETAILED DESCRIPTION

Figure 1:
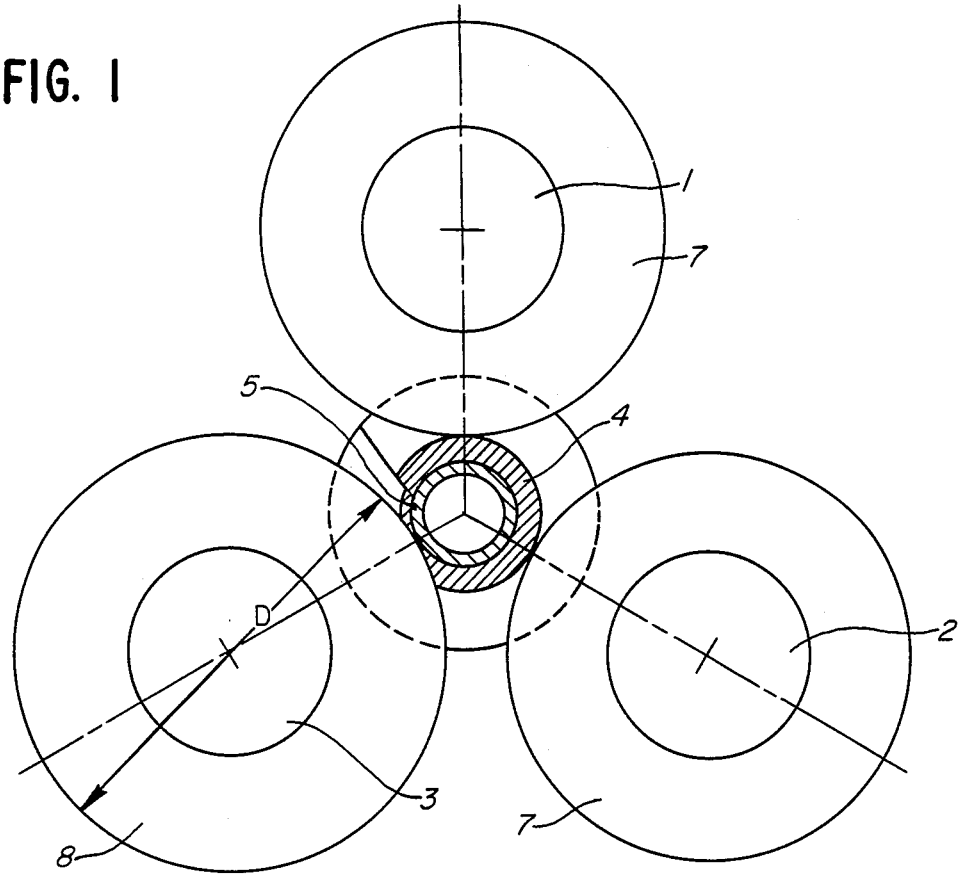
FIG. 1 is a cross-section through a set of tools in the plane perpendicular to the axis of rolling.
Figure 2:
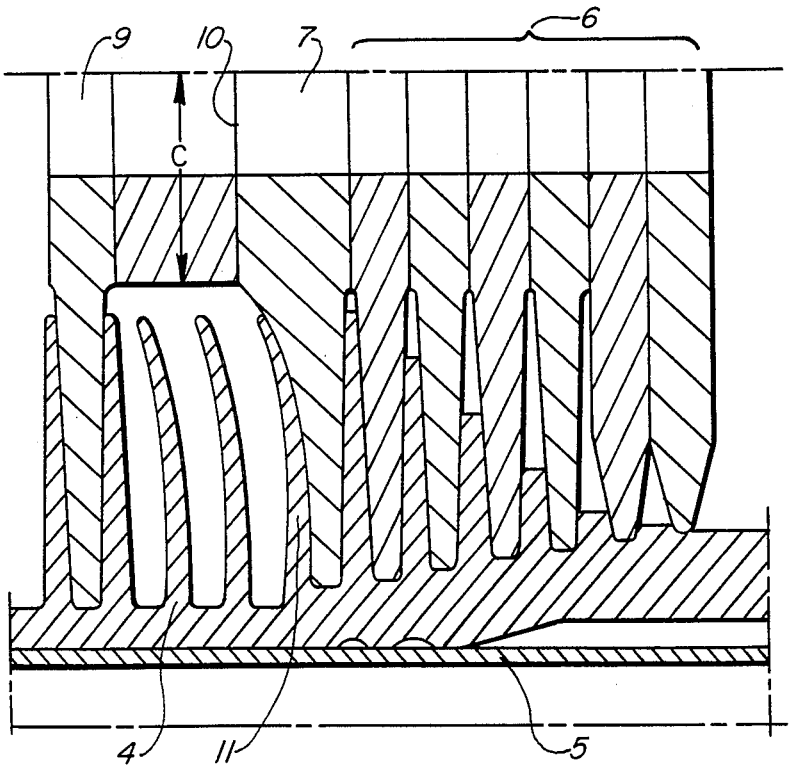
FIG. 2 is an axial section through one of the first - in the direction of rolling - tools.
Figure 4:
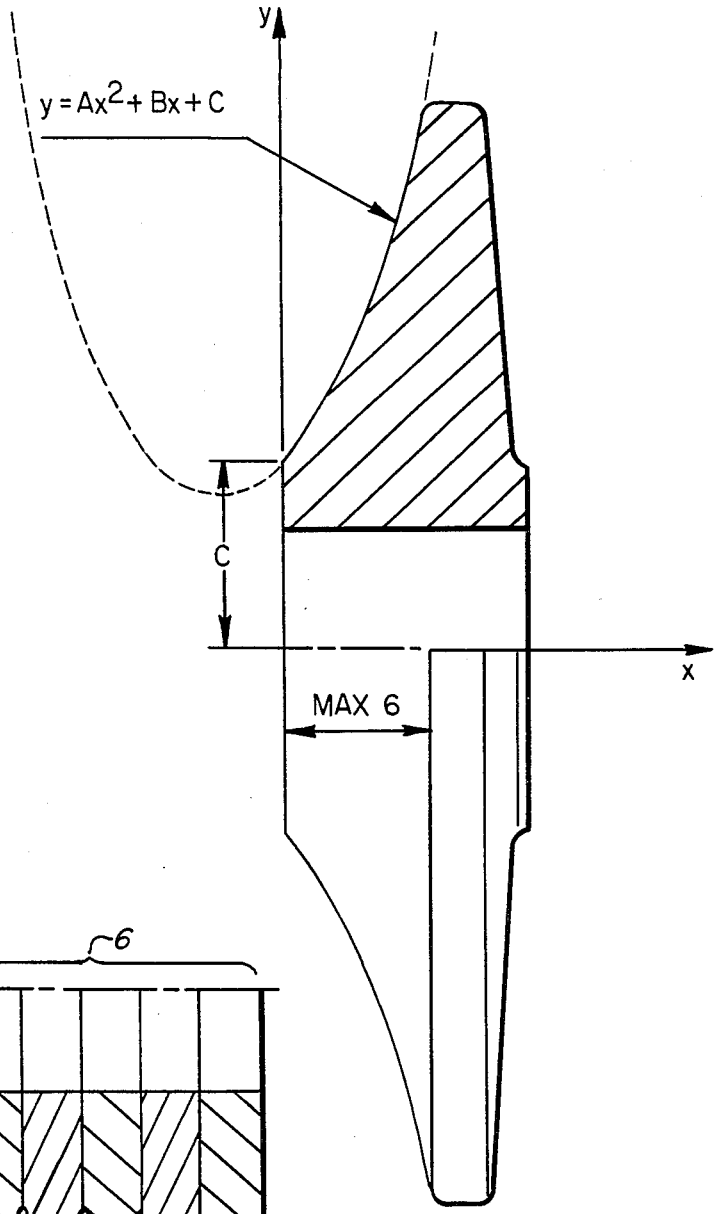
FIG. 4 shows the design of the supporting disk.
Figure 3:
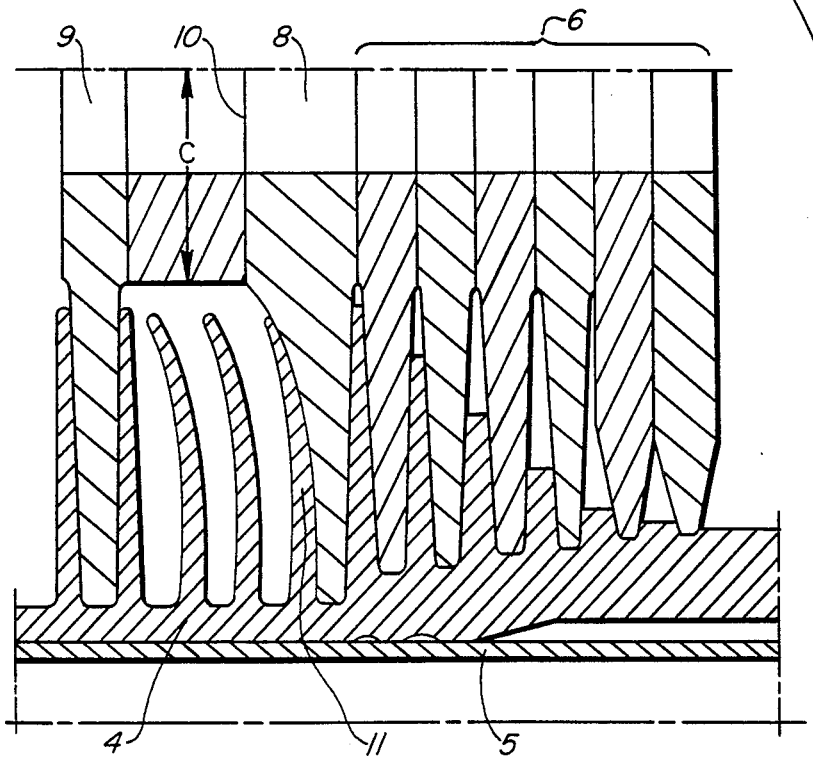
FIG. 3 is an axial section of the last - in the direction of rolling - tool.

The set of tools consists of three tolls 1, 2 and 3 situated every 120° round the external pipe 4, inside which a core pipe 5 is placed. Tools are composed of known roll-formed disks 6 forming sections of progressively deforming the pipe, of drawing the rib and of forming the shape thereof, supporting disks 7 and 8 and straightening disks 9. Supporting disks 7 and 8 have a profile in the first - in the direction of rolling - part corresponding to the profile of the last forming disk, and in the second part - parabolic. The parabole satisfies the dependence $y=Ax^2+Bx+C$, where x is the axial distance of points of the profile of the disk from the base 10 of the disk, C is the radius of the base 10 of the supporting disk, y is the radial distance of points of the profile of the supporting disk, and $A>0$ and $B\geqq 0$. The selection of quantities A and B depends on the geometry of ribs and the diameter of the external pipe 4. The external pipe 4 together with the core pipe 5 after passing through the zone of the action of roll-formed disks 6 displaces with rotary-translatory motion (helically) to the zone of the action of supporting disks 7 and 8. Supporting disks 7 situated in the first - in the direction of rolling - tools 1 and 2 deflect parabolically th rib 11. The supporting disk 8 situated on the third, the last tool 3 has an outer diameter from 0.1 to 0.8 mm larger than diameter of the first supporting disks 7. Increasing the diameter causes tightly pressing down the external pipe 4 to the core pipe 5. The rib 11 is straightened in the last stage of rolling by the straightening disk 9.

We claim:

1. A method of rolling transversely ribbed bimetallic pipes, consisting of an inner core pipe and an external pipe said onto the core pipe, in which rotary tools with formed rollers are progressively applied to the assembled pipes, whereby the external pipe is initially cut, a rib is drawn, its shape is formed, the rib is bent and the external pipe is pressed to the core pipe and, in the final rolling stage, the rib is straightened, characterized in that the rib is bent in the direction of rolling along a parabolic curve after being formed and, next, the external pipe is tightly pressed onto the core pipe, the rib is bent and the external pipe is pressed during one revolution of the pipe, whereafter the rib is straightened.

2. Apparatus for rolling transversely ribbed bimetallic pipes, consisting of three tools surrounding a bimetallic pipe assembly in which an inner core pipe is slid into an external pipe, each tool comprising a set of formed rollers constituting in succession along an axis parallel to said pipes a pipe pressure section, a rib drawing section, a rib shape forming section, a support section and a straightening section, characterized in that said support rollers have a profile whose first part in the direction of rolling corresponds to the profile of an adjacent forming roller in said rib drawing section, and whose second part has a concave profile, and in that the external diameter of the last support roller of the third tool is, in the direction of rolling, from 0.1—0.8 mm larger than the external diameter of the remaining support rollers of the other tools.

3. Apparatus according to claim 2, characterized in that said concave profile of said support rollers is defined by a paraboloid having the formula: $y=Ax^2+Bx+C$, wherein x ranges from 0 to 6 mm, along said axis of said tools, wehrein y extends transverse to said axis in the plane of the base of said support rollers, wherein coefficient $A>0$, coefficient $B\geqq 0$ and coefficient C corresponds to the radius of the base of said support rollers.

* * * * *